US008327813B2

(12) United States Patent
Tada et al.

(10) Patent No.: US 8,327,813 B2
(45) Date of Patent: Dec. 11, 2012

(54) VALVE TIMING CONTROL APPARATUS

(75) Inventors: Kenji Tada, Kariya (JP); Masayasu Ushida, Okazaki (JP)

(73) Assignee: Denso Corporation, Kariya (JP)

( * ) Notice: Subject to any disclaimer, the term of this patent is extended or adjusted under 35 U.S.C. 154(b) by 349 days.

(21) Appl. No.: 12/756,302

(22) Filed: Apr. 8, 2010

(65) Prior Publication Data

US 2010/0258069 A1 Oct. 14, 2010

(30) Foreign Application Priority Data

Apr. 9, 2009 (JP) ..... 2009-95030

(51) Int. Cl.
*F01L 9/02* (2006.01)
*F01L 1/34* (2006.01)

(52) U.S. Cl. ..... 123/90.15; 123/90.17

(58) Field of Classification Search ..... 123/90.15, 123/90.17
See application file for complete search history.

(56) References Cited

U.S. PATENT DOCUMENTS

2002/0062802 A1 5/2002 Saito et al.
2005/0022764 A1 2/2005 Kawai et al.
2005/0252468 A1* 11/2005 Tanaka et al. ..... 123/90.17
2007/0277758 A1* 12/2007 Fischer et al. ..... 123/90.17
2009/0020085 A1* 1/2009 Hattori ..... 123/90.17
2010/0154732 A1* 6/2010 Bayrakdar ..... 123/90.17

FOREIGN PATENT DOCUMENTS

EP 2017437 A1 * 1/2009
JP 2001-289013 10/2001
JP 2001289013 A * 10/2001
JP 2007-263059 10/2007
JP 4084585 2/2008
JP 2008-121558 5/2008
JP 200924600 A * 5/2009

OTHER PUBLICATIONS

Japanese Office Action dated Mar. 22, 2011, issued in corresponding Japanese Application No. 2009-095030 with English Translation.

* cited by examiner

*Primary Examiner* — Thomas Denion
*Assistant Examiner* — Steven D Shipe
(74) *Attorney, Agent, or Firm* — Nixon & Vanderhye, PC

(57) ABSTRACT

An assist spring is fixed at its one end to a vane rotor and at its other end to a spring hook provided at an outside of a housing 18. A signal plate is fixed to the vane rotor on a side of the spring hook. A cam angle sensor is provided at an outer peripheral side of the signal plate for detecting a rotational angle of the signal plate. The assist spring and the spring hook are arranged in an area, which is inside of an outer periphery of the signal plate in a radial direction, so that the cam angle sensor may not misidentify the assist spring and the spring hook and thereby exactly detects the rotational angle of the signal plate.

10 Claims, 13 Drawing Sheets

VALVE TIMING CONTROL APPARATUS

CROSS REFERENCE TO RELATED APPLICATION

This application is based on Japanese Patent Application No. 2009-095030 filed on Apr. 9, 2009, the disclosure of which is incorporated herein by reference.

FIELD OF THE INVENTION

The present invention relates to a valve timing control apparatus for an internal combustion engine for controlling valve timing of valve opening and/or valve closing of an intake valve and/or an exhaust valve.

BACKGROUND OF THE INVENTION

A valve timing control apparatus is known in the art for controlling a valve opening and/or closing timing of an intake valve and/or an exhaust valve of an engine. The valve timing control apparatus has advancing oil chambers and retarding oil chambers between a vane rotor and a housing, wherein the vane rotor is movable relative to the housing. Fluid pressure of working fluid, which is supplied into the respect advancing and retarding oil chambers, is controlled so as to control a rotational phase between the vane rotor and the housing.

According to the above conventional valve timing control apparatus, an operational mode for supplying the working fluid from an oil pump to the advancing oil chambers is changed to another operational mode for supplying the working fluid from the oil pump to the retarding oil chambers, or vice versa, so as to control the fluid pressure in the advancing and retarding oil chambers. The relative rotational position of the vane rotor to the housing is changed by such fluid pressure control, to thereby realize the control of the valve opening and/or closing timing.

It is also known in the art to provide an elastic member in the valve timing control apparatus in order to improve response of the operation, in which the elastic member biases the vane rotor to rotate in an advancing or retarding direction with respect to the housing.

In addition, it is known in the art, for example, as disclosed in Japanese Patent No. 4084585, to provide a signal rotor fixed to a vane rotor so that the signal rotor rotates together with the vane rotor. A sensor is provided at an outer peripheral side of the signal rotor to detect a rotational angle of a driving shaft or a driven shaft, with which the vane rotor rotates together.

In the case that the signal rotor and the elastic member are provided on the same side in an axial direction, that is, on a front side of the valve timing control apparatus, a sensor for detecting the rotational angle of the signal rotor may misidentify the elastic member (including a fixing member for fixing an end of the elastic member to the signal rotor) as a portion of the signal rotor. It may be, therefore, difficult to exactly detect the rotational angle of the signal rotor, which is fixed to the driving shaft or the driven shaft.

SUMMARY OF THE INVENTION

The present invention is made in view of the above problems. It is an object of the present invention to provide a valve timing control apparatus, in which an elastic member and a signal member are provided on the same side in an axial direction of the valve timing control apparatus, and according to which it is possible to exactly detect a rotational angle of the signal member fixed to a driving shaft or a driven shaft.

According to a feature of a valve timing control apparatus for an engine of the invention, a driven shaft is rotated by a driving force from a driving shaft of the engine to open and close an intake valve and an exhaust valve of the engine, and a valve opening and/or closing timing for the intake valve and/or the exhaust valve is controlled by changing a rotational phase of the driven shaft relative to the driving shaft.

The valve timing control apparatus has a housing to be rotated together with one of the driving shaft and the driven shaft, and a vane rotor connected to the other of the driving shaft and the driven shaft and rotatably supported by and in the housing, wherein the vane rotor has multiple vanes respectively accommodated in multiple accommodating spaces of the housing to define pressure chambers at both sides of each vane, and the vane rotor is capable of rotating relative to the housing depending on fluid pressure of working fluid supplied into the respective pressure chambers.

The valve timing control apparatus further has an elastic member, which is fixed to the vane rotor at one end and fixed to the housing at the other end, so as to apply a spring force to the vane rotor and the housing so that a relative movement between them is realized. A fixing member is provided at an outside of the housing, which corresponds to a front side of the housing in an axial direction of the vane rotor, for fixing the other end of the elastic member to the housing.

A signal member is fixed to the vane rotor at a side of the elastic member, which is provided at the front side of the housing, in the axial direction of the vane rotor, so that a rotational angle is detected by a sensor provided at an outer peripheral side of the signal member in the radial direction.

In the above valve timing control apparatus, the elastic member and the fixing member are provided in an area which is inside of an outer periphery of the signal member in the radial direction.

Even in the case that the elastic member, the fixing member and the signal member are provided at the front side of the housing, and axial length of the valve timing control apparatus is made smaller, it is possible to avoid a case in which the sensor would misidentify the elastic member and the fixing member as a part of the signal member. Accordingly, it is possible to exactly detect the rotational angle of the signal member. In other words, it is possible to exactly detect the rotational angle of the driving shaft (or the driven shaft), to which the signal member and the vane rotor are fixed. In addition, since the signal member is provided on the same side to the fixing member, a space can be obtained on the opposite side (on which the fixing member and the signal member are not provided). Furthermore, since the fixing member is provided at the outside of the housing, an assembling process may be improved.

According to another feature of the invention, the signal member has a large-diameter portion and a small-diameter portion, a through-hole is formed in the small-diameter portion of the signal member and extends in a circumferential direction of the signal member, and the fixing member is inserted into the through-hole in such a manner that the fixing member is movable relative to the signal member.

The sensor detects the rotational angle of the signal member by detecting the large-diameter portion. In addition, the fixing member, which fixes the other end of the elastic member to the housing, is inserted into the through-hole formed in the small-diameter portion. The fixing member is provided in the area which is inside of the outer periphery of the signal member in the radial direction. As a result, the sensor may not misidentify the elastic member and the fixing member. As above, it is possible to exactly detect the rotational angle of the signal member as well as the driving shaft (or the driven shaft) to which the signal member is fixed.

According to a further feature of the invention, the signal member has a large-diameter portion and a small-diameter portion, a through-hole is formed in the large-diameter portion of the signal member and extends in a circumferential direction of the signal member, and the fixing member is inserted into the through-hole in such a manner that the fixing member is movable relative to the signal member.

The sensor detects the rotational angle of the signal member by detecting the large-diameter portion. In addition, the fixing member, which fixes the other end of the elastic member to the housing, is inserted into the through-hole formed in the large-diameter portion. The fixing member is provided in the area which is inside of the outer periphery of the signal member in the radial direction. As a result, the sensor may not misidentify the elastic member and the fixing member. As above, it is possible to exactly detect the rotational angle of the signal member as well as the driving shaft (or the driven shaft) to which the signal member is fixed.

So long as the through-hole, which is formed in the large-diameter portion, is formed in the area inside of the outer periphery of the large-diameter portion in the radial direction, the through-hole may be formed in an area which is outside of an outer periphery of the small-diameter portion.

According to a still further feature of the invention, the signal member has a wall portion outwardly extending from an outer periphery thereof in the axial direction of the vane rotor. As a result, flexibility for locating the cam angle sensor in the axial direction of the vane rotor is increased by the height of the wall portion.

According to a still further feature of the invention, the wall portion may be formed in an angular range larger than that of the through-hole.

According to a still further feature of the invention, the signal member may have a spring accommodating portion for accommodating the elastic member therein and the one end of the elastic member is fixed to a positioning portion formed in the spring accommodating portion.

According to a still further feature of the invention, the signal member and the spring accommodating portion may be integrally formed with each other. As a result, a number of parts and components can be reduced.

According to a still further feature of the invention, the signal member may be separately formed from the spring accommodating portion. As a result, it becomes easier to manufacture respective member and portion.

According to a still further feature of the invention, the positioning portion may be integrally formed with the spring accommodating portion. As a result, a number of parts and components can be reduced.

According to a still further feature of the invention, the positioning portion may be separately formed from the spring accommodating portion. Then, it becomes possible to integrally form the spring accommodating portion and the signal member by the press working. As a result, the manufacturing cost can be reduced.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

Embodiments of the present invention will be explained with reference to the drawings.

First Embodiment

A valve timing control apparatus of the first embodiment of the present invention will be explained with reference to FIGS. 1 to 5. The valve timing control apparatus 1 according to the first embodiment is a valve timing control apparatus for an exhaust valve of an internal combustion engine for a vehicle.

Figure 1:
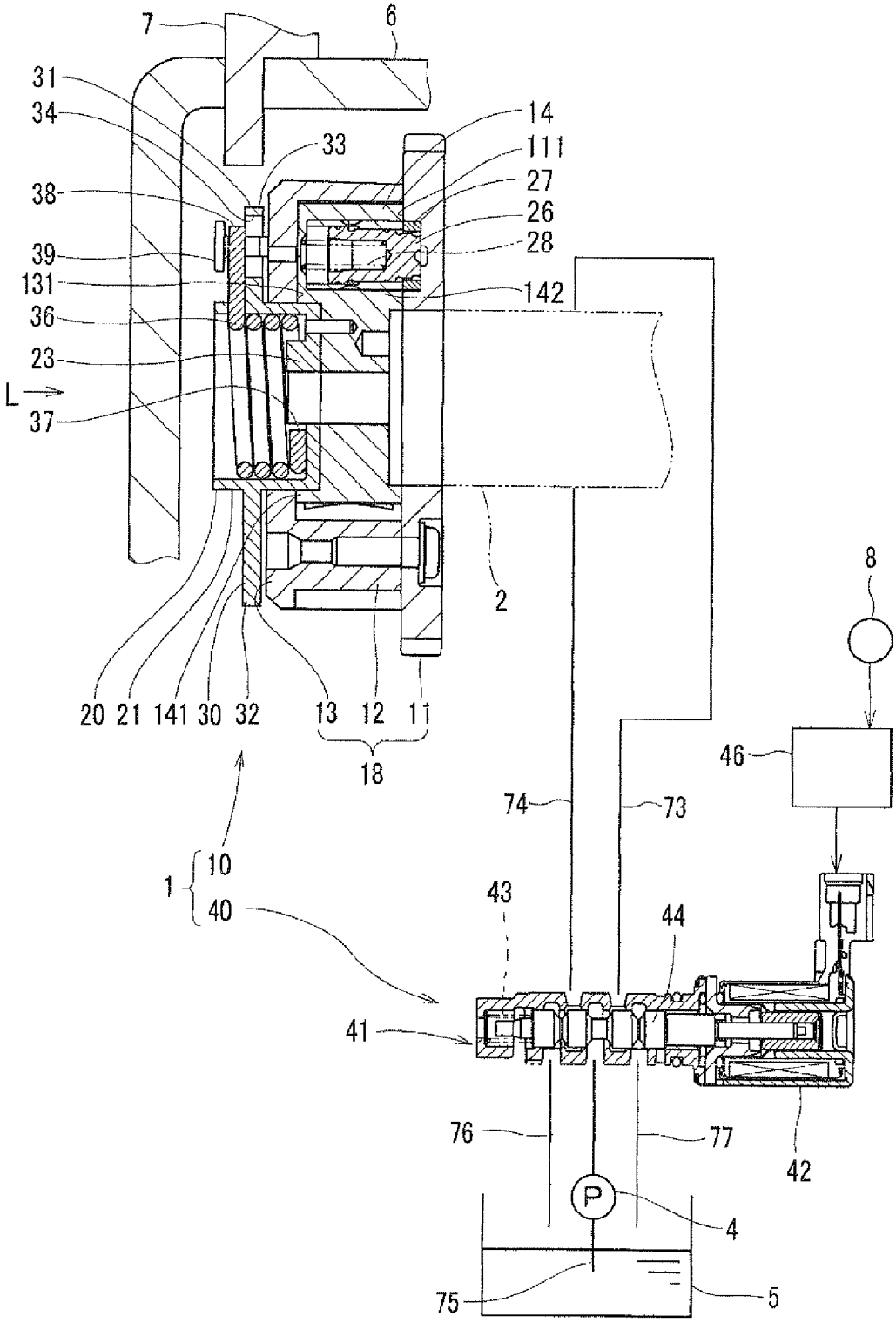
FIG. 1 is a schematic view showing a valve timing control apparatus according to a first embodiment of the invention.
Figure 5:
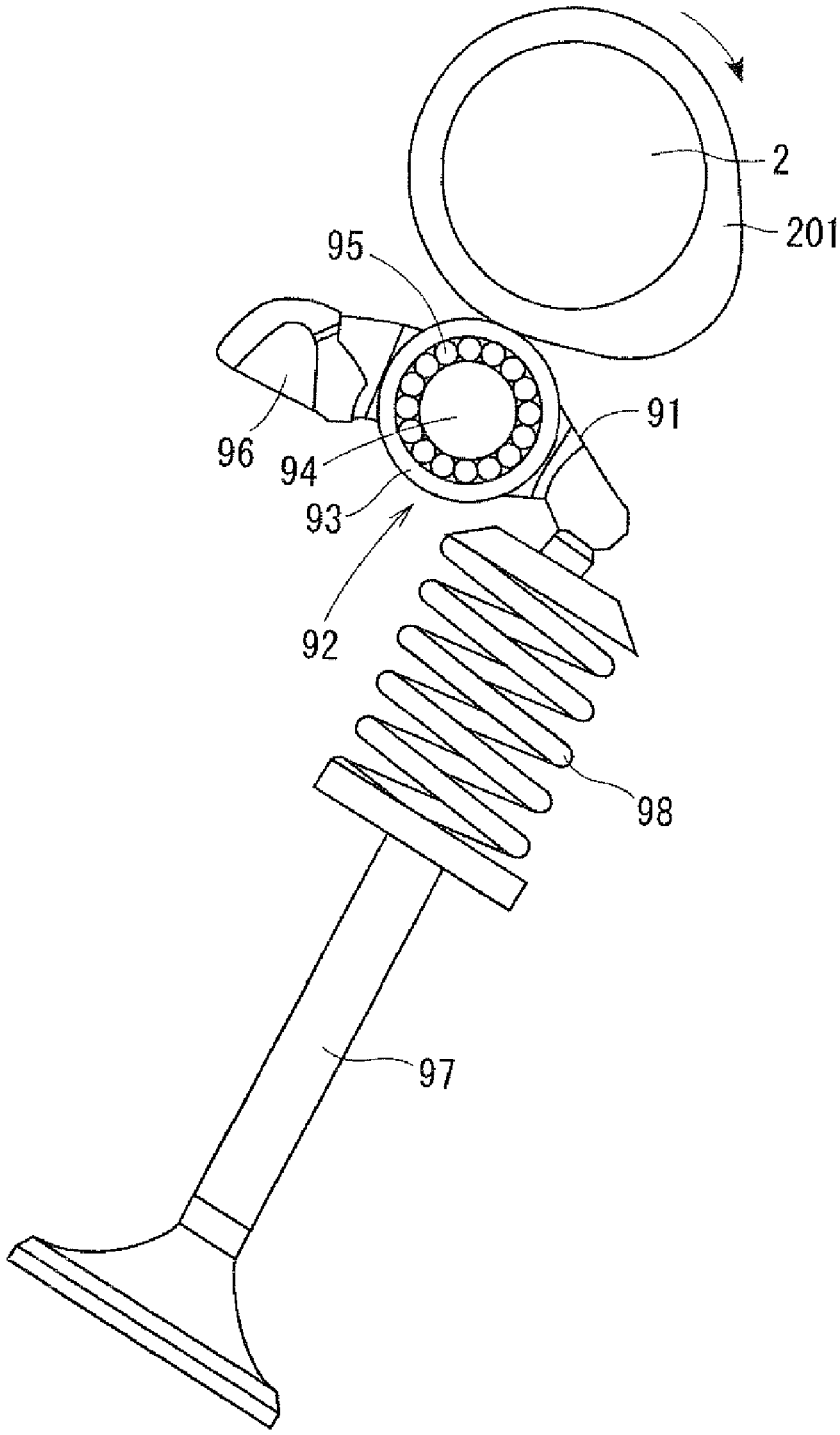
FIG. 5 is a schematic view showing a power transmitting system according to the first embodiment of the invention.

As shown in FIG. 5, the valve timing control apparatus 1 is provided in a power transmitting system for transmitting a driving power of a crank shaft (a driving shaft) to an exhaust valve 97. As shown in FIG. 1, the valve timing control apparatus 1 is composed of a valve timing adjusting device 10 having a cam shaft 2 (a driven shaft) and a fluid control device 40 for controlling supply of working fluid to the valve timing adjusting device 10.

At first, the power transmitting system will be explained with reference to FIG. 5.

The power transmitting system is a roller-rocker type system, which is composed of a rocker arm 91 for transmitting the driving power from the cam shaft 2 to the exhaust valve 97 and a roller 92 which is in a rolling contact with a cam integrally rotated with the cam shaft 2. The roller 92 is composed of an outer race 93 being in the rolling contact with the cam 201, an inner race 94 supported by the rocker arm 91, and a rolling element 95 for rotatably supporting the outer race 93 with respect to the inner race 94. One end of the rocker arm 91 is in contact with an upper end of the exhaust valve 97 and the other end thereof is provided with a pivot concave 96 to which a pivot (not shown) is connected.

Figure 2:
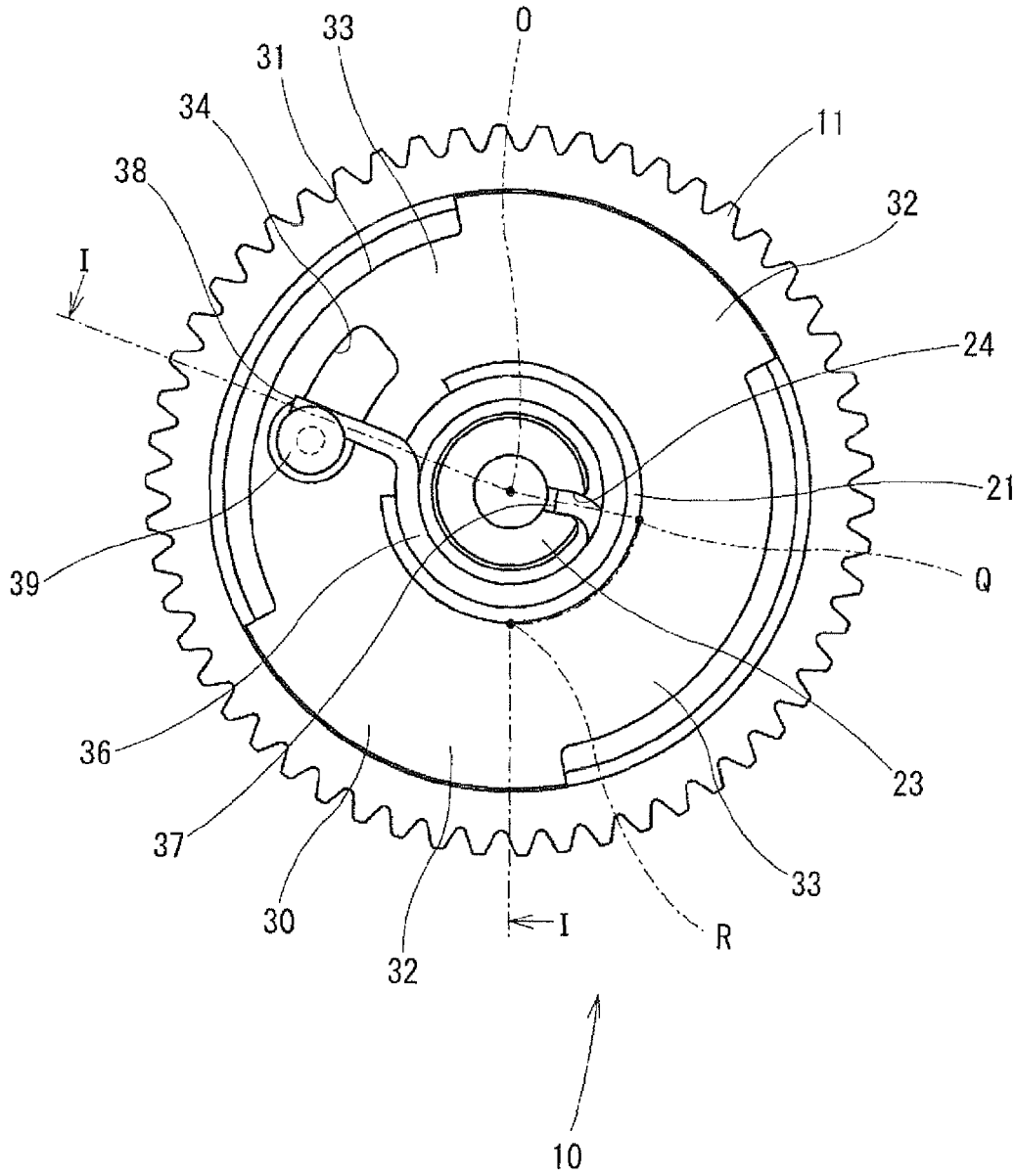
FIG. 2 is a schematic view showing the valve timing control apparatus of FIG. 1, when viewed in a direction of an arrow L and an engine cover is removed.

The valve timing adjusting device 10 will be explained with reference to FIGS. 1 to 3. FIG. 1 is a cross sectional view taken along a line I-O-Q-R-I in FIG. 2. FIG. 2 is a view showing the valve timing adjusting device 10 when viewed in a direction of an arrow L in FIG. 1, when an engine cover 6 is removed.

The valve timing adjusting device 10 is arranged within the engine cover 6 and is composed of a housing 18, a vane rotor 14, an assist spring 36 of an elastic element, a spring hook 39 as a fixing member, a signal plate 30 (also referred to as a signal member) as a detecting member, and so on.

The housing 18 is composed of a sprocket 11, a cylindrical shoe housing 12, and a disc-shaped front plate 13. The shoe housing 12 and the front plate 13, are integrally formed with each other.

Figure 3:
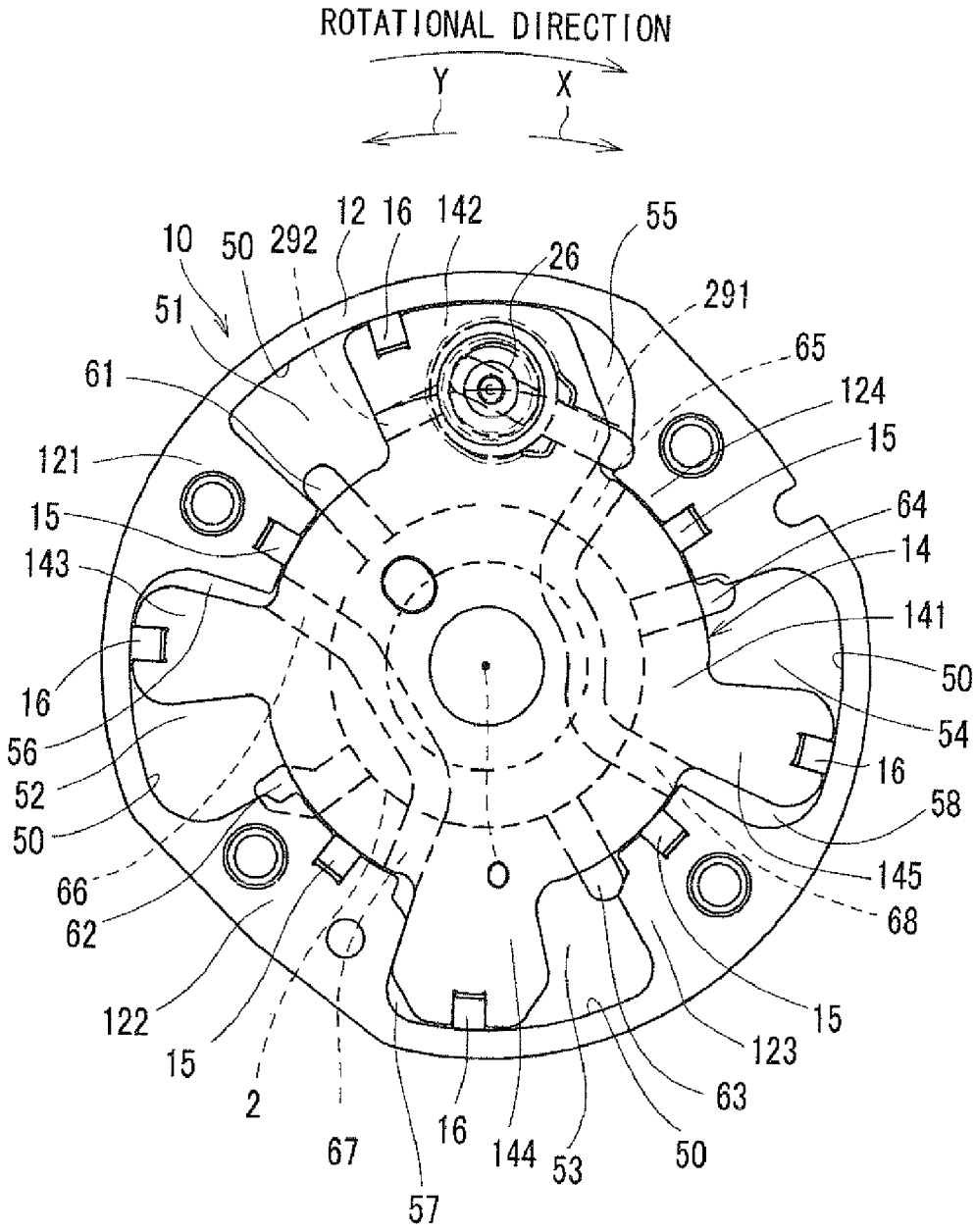
FIG. 3 is a schematic view showing the valve timing control apparatus for explaining a structure thereof.

As shown in FIG. 3, the shoe housing 12 has multiple shoes 121, 122, 123 and 124, which are formed at equal intervals in a circumferential direction (in a rotating direction) and each of which inwardly projects in a radial direction from an inner peripheral wall. Each of projected ends of the shoes 121 to 124 has an arc shape when viewed in a direction perpendicular to the drawing sheet. An inner surface of each projected end slides on an outer peripheral surface of a boss portion 141 of the vane rotor 14. A recessed portion is formed at each projected end of the shoes 121 to 124 and a seal member 15 is inserted into the recessed portion. An accommodating space 50 is respectively formed between the neighboring shoes 121 to 124 in the rotating direction. Each of the accommodating spaces 50 is defined by the inner peripheral wall and side walls of the corresponding shoes. The accommodating space 50 has a fan shape, when viewed in the direction perpendicular to the drawing sheet.

The sprocket 11, the shoe housing 12 and the front plate 13 are coaxially connected to each other by multiple bolts. The shoe housing 12 is interposed between the sprocket 11 and the front plate 13. The sprocket 11 is operatively connected to the crank shaft via a chain (not shown). A driving force is transmitted from the crank shaft to the sprocket 11, so that the housing 18 (11, 12, 13) is rotated together with the crank shaft. The housing 18 is rotated in a clockwise direction in FIG. 3.

The vane rotor 14 is accommodated in the housing 18. Each of axial end surfaces of the vane rotor 14 is in a sliding contact with an inner surface 111 of the sprocket 11 and an inner surface 131 of the front plate 13. The vane rotor 14 has the boss portion 141 and multiple vanes 142, 143, 144 and 145.

As shown in FIG. 3, the vanes 142 to 145 are formed at equal intervals in the rotating direction. Each of the vanes outwardly projects in the radial direction from an outer peripheral wall of the boss portion 141, and accommodated in the accommodating space 50. Each of projected ends of the vanes 142 to 145 has an arc shape when viewed in the direction perpendicular to the drawing sheet. An outer surface of each projected end slides on the inner peripheral wall of the shoe housing 12. A recessed portion is formed at each projected end of the vanes 142 to 145 and a seal member 16 is inserted into the recessed portion.

Each of the vanes 142 to 145 divides the corresponding accommodating space 50 into an advancing oil chamber (51, 52, 53, 54) and a retarding oil chamber (55, 56, 57, 58) in the rotating direction. More exactly, the advancing oil chamber 51 is formed between the shoe 121 and the vane 142. The advancing oil chamber 52 is formed between the shoe 122 and the vane 143. The advancing oil chamber 53 is formed between the shoe 123 and the vane 144. And the advancing oil chamber 54 is formed between the shoe 124 and the vane 145. In the similar manner, the retarding oil chamber 55 is formed between the shoe 124 and the vane 142. The retarding oil chamber 56 is formed between the shoe 121 and the vane 143. The retarding oil chamber 57 is formed between the shoe 122 and the vane 144. And the retarding oil chamber 58 is formed between the shoe 123 and the vane 145.

When the vane rotor 14 is moved relative to the housing 18 to a position shown in FIG. 3 (that is, a most advanced position), volume of each advancing oil chamber 51 to 54 becomes maximum, while volume of each retarding oil chamber 55 to 58 becomes minimum. On the other hand, when the vane rotor 14 is moved relative to the housing 18 to a most retarded position, the volume of the advancing oil chamber 51 to 54 becomes minimum, while the volume of the retarding oil chamber 55 to 58 becomes maximum.

Each of the advancing oil chambers 51 to 54 is respectively communicated to advancing fluid passages 61 to 64 formed in the sprocket 11. Each of the advancing fluid passages 61 to 64 is connected to an advancing passage (not shown) formed in the cam shaft 2. Each of the retarding oil chambers 55 to 58 is respectively communicated to retarding fluid passages 65 to 68 formed in the vane rotor 14. Each of the retarding fluid passages 65 to 68 is connected to a retarding passage (not shown) formed in the cam shaft 2. Each of the advancing oil chambers 51 to 54 and the retarding oil chambers 55 to 58 forms an oil pressure chamber.

As shown in FIG. 1, a stopper pin 26 is movably supported by the vane 142 in a reciprocating manner. The stopper pin 26 is biased by a compression coil spring 28 in a direction to the sprocket 11. When the stepper pin 26 is pushed by the spring 28 and engaged into a fixing hole formed by a ring 27 provided in the sprocket 11, the vane rotor 14 is locked to its most advanced position with respect to the housing 18. In other words, the relative movement of the vane rotor 14 to the housing 18 is restricted by the engagement of the stopper pin 26 into the fixing hole of the ring 27.

Oil pressure may be applied to the stopper pin 26 either from the retarding oil chamber 55 via a first fluid passage 291 or from the advancing oil chamber 51 via a second fluid passage 292. When the oil pressure is applied to the stopper pin 26, the stopper pin 26 is moved in a direction opposing to the spring force of the coil spring 28, and thereby the stopper pin 26 is brought out of the engagement with the fixing hole of the ring 27. Then, it becomes possible for the vane rotor 14 to rotate relative to the housing 18.

A bush member 20, which is fixed to the boss portion 141 of the vane rotor 14, is inserted into a center through-hole formed in the front plate 13, in such a way that the bush member 20 is coaxially arranged with the front plate 13 and a relative movement between the bush member 20 and the front plate 13 is allowed. The boss portion 141 of the vane rotor 14 is fixed to the cam shaft 2 by bolts together with the bush member 20. The vane rotor 14 and the cam shaft 2 rotate in the clockwise direction in FIG. 3. The vane rotor 14 as well as the camshaft 2 can rotate relative to the housing 18. An arrow X in FIG. 3 designates a moving direction of the vane rotor 14 relative to the housing 18, which is the advancing direction. On the other hand, an arrow Y in FIG. 3 designates a moving direction of the vane rotor 14 relative to the housing 18, which is the retarding direction. FIG. 3 shows the vane rotor 14 in the most advanced position, in which further rotation of the vane rotor 14 relative to the housing 18 in the direction X (the advancing direction) is restricted, while the rotation of the vane rotor 14 relative to the housing 18 in the direction Y (the retarding direction) may be allowed.

As shown in FIGS. 1 and 2, the signal plate 30, the assist spring 36 and the spring hook 39 are provided on a front side of the housing 18, namely on the side of the front plate 13.

The bush member 20 is composed of a cup-shaped portion 21 and the signal plate 30. The cup-shaped portion 21 is formed in a cylindrical shape having a bottom for accommodating therein the assist spring 36. A forward end of the cup-shaped portion 21 is inserted into the boss portion 141 of the vane rotor 14 and fixed to the vane rotor 14 by means of the bolts, as already explained above. A positioning portion 23 is integrally formed at the bottom of the cup-shaped portion 21, wherein the positioning portion 23 projects in a direction of an open end (in a leftward direction) of the cup-shaped portion 21. As shown in FIG. 2, a positioning groove 24 is formed at the positioning portion 23 in order to hold one end 37 of the assist spring 36.

The signal plate 30 is integrally formed with the cup-shaped portion 21. The signal plate 30 is formed in a disc shape outwardly extending from the cup-shaped portion 21. Therefore, the signal plate 30 rotates together with the vane rotor 14 and the cam shaft 2. The signal plate 30 has a large-diameter portion 32 and a small-diameter portion 33. A long through-hole 34 extending in a circumferential direction is formed in the small-diameter portion 33.

A cam angle sensor 7 is provided to the engine cover 6 at an outer peripheral side of the signal plate 30, namely at such a position, at which the cam angle sensor 7 faces to the signal plate 30. The cam angle sensor 7 detects the large-diameter portion 32 of the signal plate 30, so as to detect rotational angle of the cam shaft 2 which rotates together with the signal plate 30 and the vane rotor 14.

The spring hook 39 is inserted into the long through-hole 34 of the signal plate 30. The spring hook 39 is provided at an outer side of the housing 18 and fixed to the front plate 13. Therefore, the spring hook 39 can rotate together with the housing 18 relative to the signal plate 30 within a range of the long through-hole 34.

The assist spring 36 is a helical torsion spring, one end 37 of which is held by the vane rotor 14 and the other end 38 of which is held by the housing 18, so that spring force of the assist spring 36 is applied to the vane rotor 14 to bias the vane rotor 14 in the advancing direction X relative to the housing 18. The assist spring 36 is accommodated in the cup-shaped portion 21 and its one end 37 is engaged with the positioning groove 24, so that the one end 37 of the assist spring 36 rotates together with the vane rotor 14.

The other end 38 of the assist spring 36 outwardly extends in the radial direction and engaged with the spring hook 39, so that the other end 38 rotates together with the spring hook 39 and the housing 18 within a circumferential length of the long through-hole 34. At any rotational position of the vane rotor 14 relative to the housing 18, the assist spring 36 and the spring hook 39 are positioned in a place, which is located on a radial inner side of an outer periphery 31 of the signal plate 30. In other words, the assist spring 36 and the spring hook 39 are arranged in an area which is inside of the outer periphery 31 in the radial direction. As a result, the assist spring 36 and the spring hook 39 may not be accidentally detected by the cam angle sensor 7. In other words, the cam angle sensor 7 detects the rotational angle of the cam shaft 2 based on the detection of the large-diameter portion 32 of the signal plate 30, wherein the large-diameter portion 32 is on a radial outer side of the outer periphery 31. Therefore, the assist spring 36 and the spring hook 39 may not be misidentified by the cam angle sensor 7 as being the large-diameter portion 32 (in other words, as being a part of the signal plate 30).

The fluid control device 40 will be explained with reference to FIGS. 1 to 4. An advancing fluid conduit 73 and a retarding fluid conduit 74 are respectively communicated to the advancing and retarding passages (not shown) formed in the cam shaft 2.

A switching valve 41 is connected to the advancing fluid conduit 73, the retarding fluid conduit 74, a pump conduit 75, and drain conduits 76 and 77. An oil pump 4 is provided in the pump conduit 75 for sucking working fluid from an oil tank 5 and pumping out pressurized working fluid to the switching valve 41. The oil pump 4 is a mechanical type pump driven by the crank shaft. The drain conduits 76 and 77 are provided so that the working fluid may be discharged to the oil tank 5.

The switching valve 41 is operated with current supply and its operation is controlled by an electronic control unit 46. The switching valve 41 is an electromagnetic type spool valve. A driving force is generated at an electromagnetic coil 42 upon receiving the electric power. A spool 44 is moved in an axial direction in accordance with a balance between the driving force of the coil 42 and a spring force of a return spring 43. The switching valve 41 switches a position of the spool 44 depending on the current supply to the electromagnetic coil 42, in order to change a condition of fluid communication between the advancing and retarding fluid conduits 76 and 77 and the pump and drain conduits 75, 76 and 77.

Figure 4A:
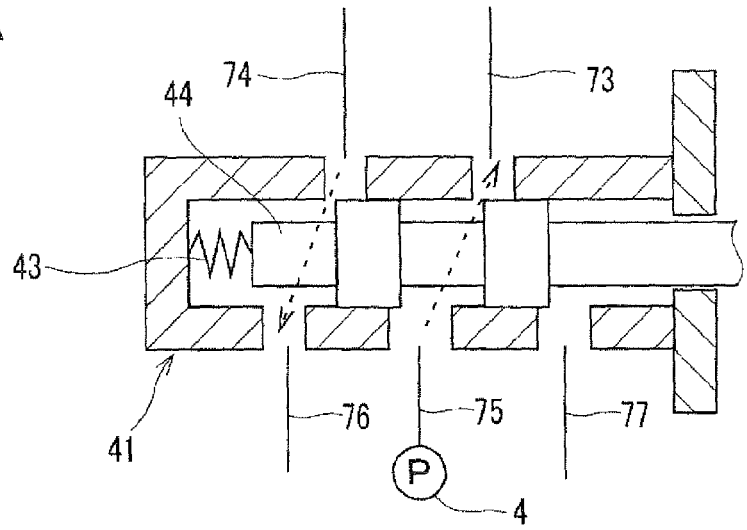
FIGS. 4A to 4C are schematic views for explaining an operation of the valve timing control apparatus according to the first embodiment.

More exactly, as shown in FIG. 4A, when the driving current supplied to the electromagnetic coil 42 is lower than a reference value Ib, the advancing fluid conduit 73 is communicated with the pump conduit 75, so that high pressure working fluid pumped out from the pump 4 is supplied into the advancing fluid conduit 73 through the pump conduit 75. At the same time, the retarding fluid conduit 74 is communicated with the drain conduit 76, so that the working fluid flows from the retarding fluid conduit 74 into the oil tank 5 through the drain conduit 76.

Figure 4B:
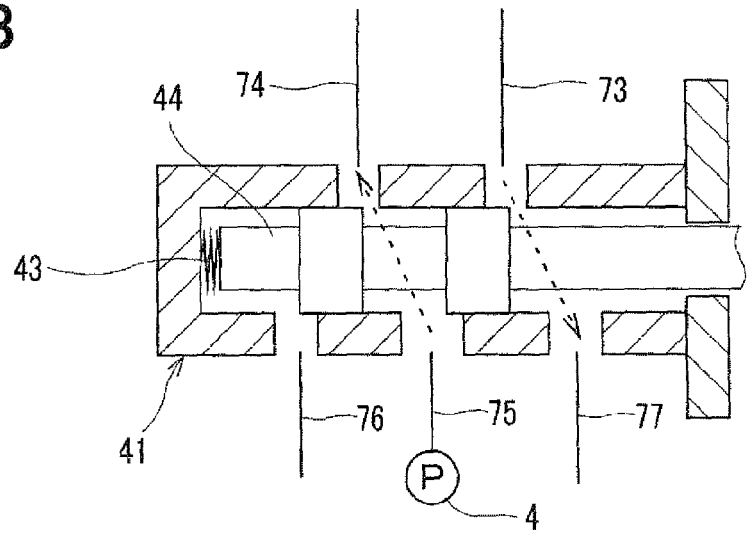

On the other hand, as shown in FIG. 4B, when the driving current supplied to the electromagnetic coil 42 is higher than the reference value Ib, the retarding fluid conduit 74 is communicated with the pump conduit 75, so that high pressure working fluid pumped out from the pump 4 is supplied into the retarding fluid conduit 74 through the pump conduit 75. At the same time, the advancing fluid conduit 73 is communicated with the drain conduit 77, so that the working fluid flows from the advancing fluid conduit 73 into the oil tank 5 through the drain conduit 77.

Figure 4C:
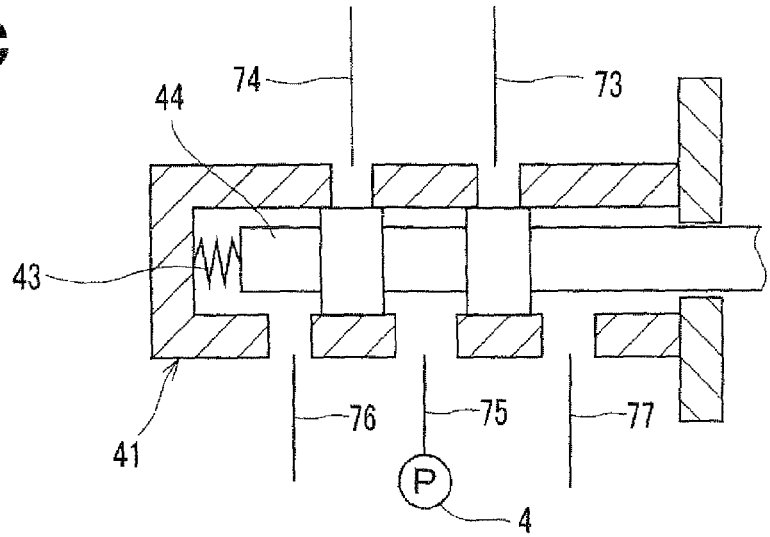

In addition, as shown in FIG. 4C, when the driving current supplied to the electromagnetic coil 42 is equal to the reference value Ib, the communication of the advancing fluid conduit 73 with the pump conduit 75, the communication of the retarding fluid conduit 74 with the pump conduit 75, and the communication of the advancing or retarding fluid conduits 73 or 74 with the drain conduits 76 or 77 are shut off. As a result, on one hand, the high pressure working fluid from the oil pump 4 is supplied to neither the advancing fluid conduit 73 nor the retarding fluid conduit 74. On the other hand, the working fluid in the advancing and the retarding fluid conduits 73 and 74 are maintained therein, without being drained to the oil tank 5.

The ECU 46 is composed of electric circuits, such as a micro computer. The switching valve 41 is electrically connected the ECU 46. The cam angle sensor 7, a crank angle sensor 8 and other sensors (not shown) are also electrically connected to the ECU 46. The ECU 46 calculates actual phases and target phases for the rotational phase of cam shaft 2 with respect to the crank shaft, based on outputs from the sensors. The ECU 46 controls the current supply to the switching valve 41 (namely, the driving power to the switching valve 41) based on calculated results for the rotational phase of cam shaft 2 with respect to the crank shaft. The crank angle sensor 8 is arranged at a place adjacent to the crank shaft to detect the rotational angle of the crank shaft. An electric line for connecting the cam angle sensor 7 to the ECU 46 is eliminated from the drawing of FIG. 1 for the purpose of simplification.

An operation of the valve timing control apparatus 1 will be explained. It is supposed that stopper pin 26 is engaged into the ring 27 by the spring force of the compression coil spring 28 and the vane rotor 14 is held at the most advanced position, when the engine operation is stopped.

(Operation at Starting the Engine)

When the engine operation starts, the oil pump 4 starts its operation. The ECU 46 controls the switching valve 41 so that the retarding fluid conduit 74 is communicated with the pump conduit 75. The high pressure working fluid from the oil pump 4 is supplied into the retarding oil chambers 55 to 58 via the retarding fluid passages 65 to 68. As a result, the stopper pin 26 receives the high pressure from the retarding oil chamber 55 through the first fluid passage 291. When the oil pressure is increased to a predetermined value, the stopper pin 26 is moved and brought out of the engagement with the ring 27. The vane rotor 14 becomes in a condition, in which the vane rotor 14 is rotatable relative to the housing. 18.

(Operation for Advancing Valve Timing)

After starting the engine operation, the ECU 46 controls the switching valve 41 so that either the advancing fluid conduit 73 or the retarding fluid conduit 74 is communicated to the pump conduit 75. When the advancing fluid conduit 73 is communicated with the oil pump 4, the working fluid sucked by the oil pump 4 is supplied to the advancing oil chambers 51 to 54 via the advancing fluid conduit 73 and the advancing fluid passages 61 to 64. In this situation, the working fluid in the retarding oil chambers 55 to 58 is discharged to the oil tank 5 via the retarding fluid passages 65 to 68 and the retarding fluid conduit 74. As a result, the fluid pressure of the working fluid is applied to the vanes 142 to 145 facing to the advancing oil chambers 51 to 54, and thereby the vane rotor 14 is rotated relative to the housing 18 in the advancing direction X.

(Operation for Retarding Valve Timing)

When the retarding fluid conduit 74 is communicated with the oil pump 4, the working fluid sucked by the oil pump 4 is supplied to the retarding oil chambers 55 to 58 via the retarding fluid conduit 74 and the retarding fluid passages 65 to 68. In this situation, the working fluid in the advancing oil chambers 51 to 54 is discharged to the oil tank 5 via the advancing fluid passages 61 to 64 and the advancing fluid conduit 73. As a result, the fluid pressure of the working fluid is applied to the vanes 142 to 145 facing to the retarding oil chambers 55 to 58, and thereby the vane rotor 14 is rotated relative to the housing 18 in the retarding direction Y.

As above, according to the present embodiment, when the supply line for the working fluid from the oil pump 4 is switched from one condition to the other condition, the fluid pressure in the advancing oil chambers 51 to 54 and the fluid pressure in the retarding oil chambers 55 to 58 are controlled. The rotational phase of the vane rotor 14 relative to the housing 18 is controlled, and thereby the valve timing is controlled. During the operation for controlling the valve timing, the ECU 46 controls the switching valve 41 in a feedback manner so that an actual valve timing of the exhaust valve 97 will be controlled to be closer to the target valve timing. Accordingly, it is possible to exactly control (adjust) the valve timing.

(Operation at Stopping the Engine)

When the engine operation is stopped, the operation of the oil pump 4 is also stopped. The high pressure working fluid is supplied neither to the advancing fluid conduit 73 nor to the retarding fluid conduit 74. Then, the vane rotor 14 is rotated relative to the housing 18 by the spring force of the assist spring 36 to the most advanced position. And the stopper pin 26 is engaged into the ring 27.

As explained above, according to the valve timing control apparatus 1 of the present embodiment, all of the assist spring 36, the spring hook 39, and the signal plate 30 are arranged on the side of the spring hook 39 (in the axial direction of the vane rotor 14), namely on the side of the front plate 13 which is the front side of the valve timing control apparatus 1.

In addition, the assist spring 36 and the spring hook 39 are positioned in the place, which is located on the radial inner side of the outer periphery 31 of the signal plate 30. Therefore, even when dimensions of the valve timing control apparatus 1 are made smaller, the cam angle sensor 7 (which detects the rotational angle of the signal plate 30 at the outer peripheral side of the signal plate 30) may not misidentify the assist spring 36 and the spring hook 39. As a result, it is possible to exactly detect the rotational angle of the signal plate 30. In other words, it is possible to exactly detect the rotational angle of the camshaft 2 which rotates together with the signal plate 30 and the vane rotor 14.

Furthermore, since the assist spring 36, the spring hook 39, and the signal plate 30 are arranged on the front side of the housing 18, a more space can be obtained on the opposite side, that is, the side of the cam shaft 2. In addition, since the spring hook 39 is provided at the outside of the housing 18, an assembling process may be improved.

The signal plate 30 has the large-diameter portion 32 and the small-diameter portion 33. The spring hook 39 is inserted into the long through-hole 34 formed in the small-diameter portion 33 and extending in the circumferential direction, so that the spring hook 39 is movable relative to the signal plate 30. The cam angle sensor 7 detects the rotational angle of the cam shaft 2 which rotates together with the signal plate 30 and the vane rotor 14, based on the detection of the large-diameter portion 32 of the signal plate 30.

The spring hook 39, by which the other end 38 of the assist spring 36 is held, is inserted into the long through-hole 34 formed in the small-diameter portion 33, and the assist spring 36 is arranged at the position, which is on the radial inner side of the outer periphery 31 of the signal plate 30. As a result, the cam angle sensor 7 may not misidentify the assist spring 36 and the spring hook 39. Accordingly, the cam angle sensor 7 can exactly detect the rotational angle of the camshaft 2, which rotates together with the signal plate 30 and the vane rotor 14.

The valve timing control apparatus 1 has the cup-shaped portion 21 fixed to the vane rotor 14. The one end 37 of the assist spring 36 is held by the cup-shaped portion 21. Since the cup-shaped portion 21 is integrally formed with the signal plate 30, a number of parts and components can be reduced.

In addition, since the positioning portion 23 is integrally formed with the cup-shaped portion 21, the number of parts and components is further reduced.

Second Embodiment

Figure 6:
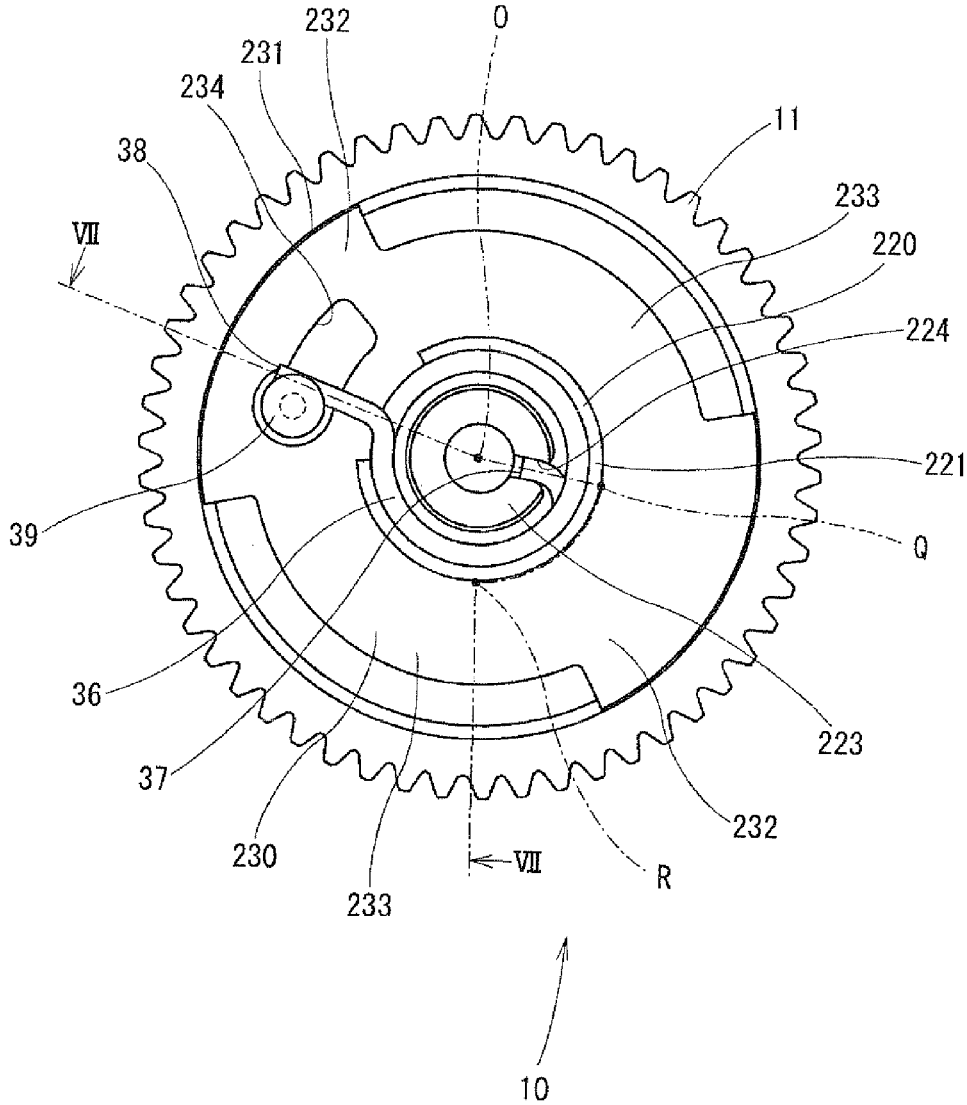
FIG. 6 is a schematic plan view showing a valve timing control apparatus according to a second embodiment of the invention.
Figure 7:
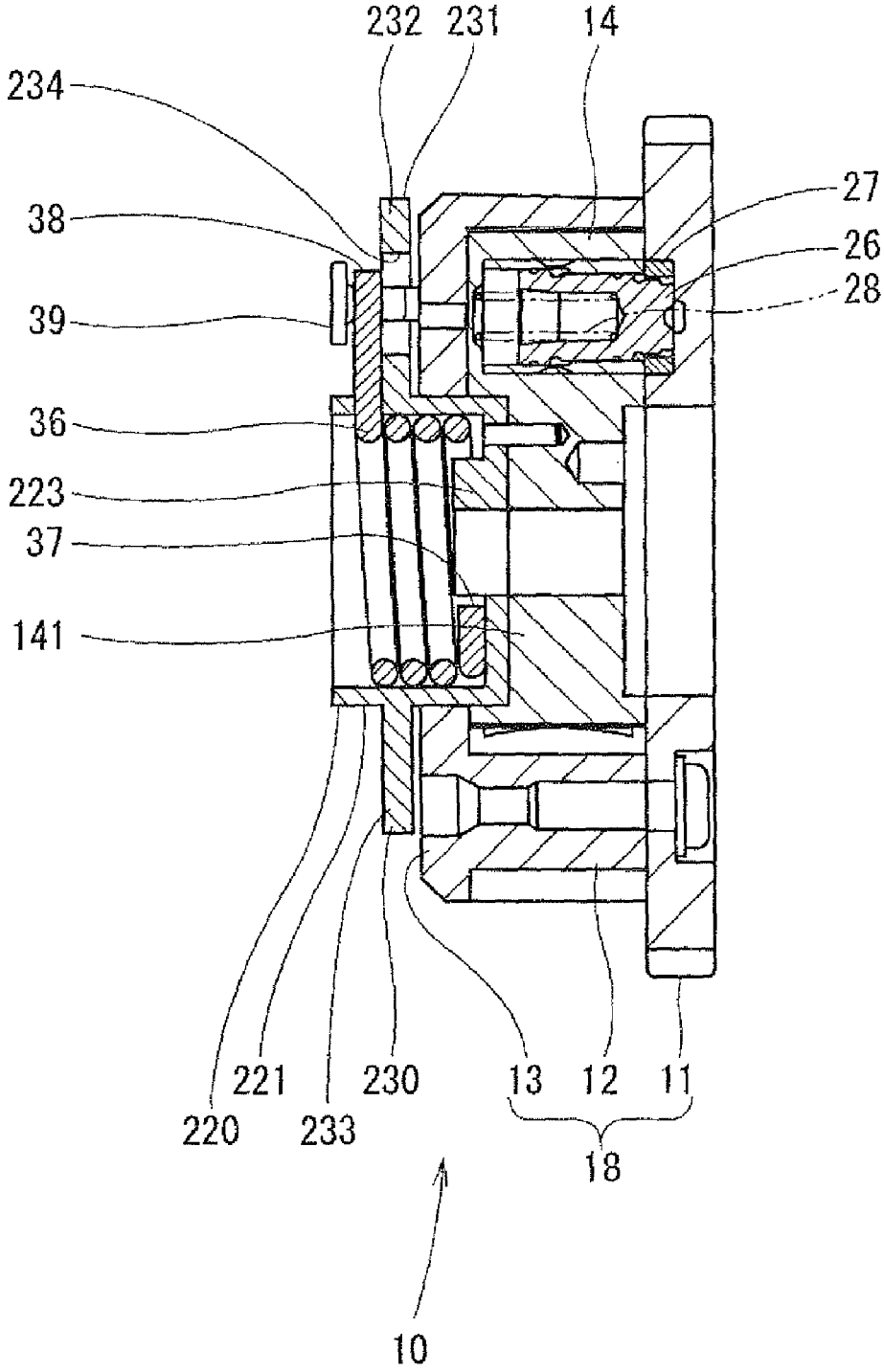
FIG. 7 is a cross sectional view taken along a line VII-O-Q-R-VII in FIG. 6.

A second embodiment differs from the first embodiment in the configuration of the bush member. Different portions will be explained with reference to FIGS. 6 and 7. The same reference numerals are used in the second embodiment for such portions which are the same or similar to those of the first embodiment, and the explanation for such portions are omitted. FIG. 6 corresponds to FIG. 2 for the first embodiment, and shows the valve timing control apparatus. FIG. 7 shows a cross sectional view taken along a line VII-O-Q-R-VII in FIG. 6, wherein only the valve timing adjusting device 10 is shown.

A bush member 220, which is fixed to the boss portion 141 of the vane rotor 14, is inserted into the center through-hole formed in the front plate 13, in such a way that the bush member 220 is coaxially arranged with the front plate 13 and a relative movement between the bush member 220 and the front plate 13 is allowed. The boss portion 141 of the vane rotor 14 is fixed to the cam shaft 2 by bolts together with the bush member 220 (FIG. 1). The bush member 220 is composed of a cup-shaped portion 221 and a signal plate 230, and so on.

The cup-shaped portion 221 is formed in a cylindrical shape having a bottom. A forward end of the cup-shaped portion 221 is inserted into the boss portion 141 of the vane rotor 14 and fixed to the vane rotor 14 by means of the bolts. The assist spring 36 is accommodated in the cup-shaped portion 221. One end 37 of the assist spring 36 is engaged with a positioning groove 224 formed at a positioning portion 223 of the cup-shaped portion 221, so that the one end 37 of the assist spring 36 rotates together with the vane rotor 14.

The signal plate 230 is integrally formed with the cup-shaped portion 221. The signal plate 230 is formed in a disc shape outwardly extending from the cup-shaped portion 221. Therefore, the signal plate 230 rotates together with the vane rotor 14 and the camshaft 2. The signal plate 230 has a large-diameter portion 232 and a small-diameter portion 233. A long through-hole 234 extending in a circumferential direction is formed in the large-diameter portion 232.

The spring hook 39 is inserted into the long through-hole 234 of the signal plate 230. The spring hook 39 is fixed to the front plate 13 of the housing 18. The other end 38 of the assist spring 36 is held by the spring hook 39. Therefore, the other end 38 of the assist spring 36 can rotate together with the spring hook 39 and the housing 18 relative to the signal plate 230 within the range of the long through-hole 234. At any rotational position of the vane rotor 14 relative to the housing 18, the assist spring 36 and the spring hook 39 are positioned in the place, which is located on the radial inner side of the outer periphery 231 of the signal plate 230.

According to the above structure, since the cam angle sensor 7 (FIG. 1) does not misidentify the assist spring 36 and the spring hook 39, the cam angle sensor 7 can exactly detect the rotational angle of the cam shaft 2 which rotates together with the signal plate 230 and the vane rotor 14.

So long as the long through-hole 234 is formed in the large-diameter portion 232 at the place inside of the outer periphery 231 in the radial direction, the above effect can be achieved, even in the case that the long through-hole 234 is formed at such a place which is an outside of an outer periphery of the small-diameter portion 233 in the radial direction but within an angular range of the large-diameter portion 232 in the radial direction.

In other words, so long as a distance of the spring hook 39 from a rotational center (O) of the vane rotor 14 is smaller than that of the outer periphery 231 of the large-diameter portion 232, the same effect of the invention to the first embodiment can be obtained, even in the case that the distance of the spring hook 39 from the rotational center (O) of the vane rotor 14 is larger than that of the outer periphery 231 of the small-diameter portion 233.

Since the cup-shaped portion 221 is integrally formed with the signal plate 230, a number of parts and components can be reduced. In addition, since the positioning portion 223 is integrally formed with the cup-shaped portion 221, the number of parts and components is further reduced.

Third Embodiment

Figure 8:
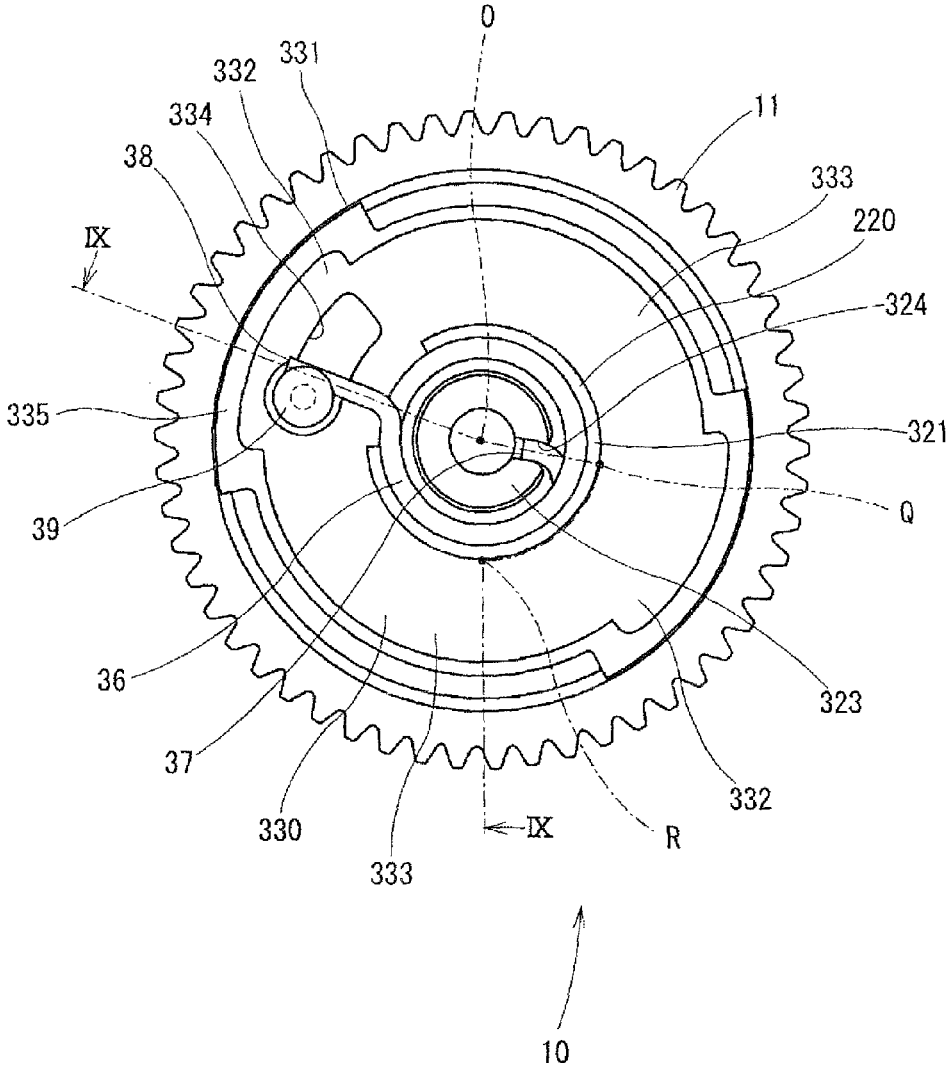
FIG. 8 is a schematic plan view showing a valve timing control apparatus according to a third embodiment of the invention.
Figure 9:
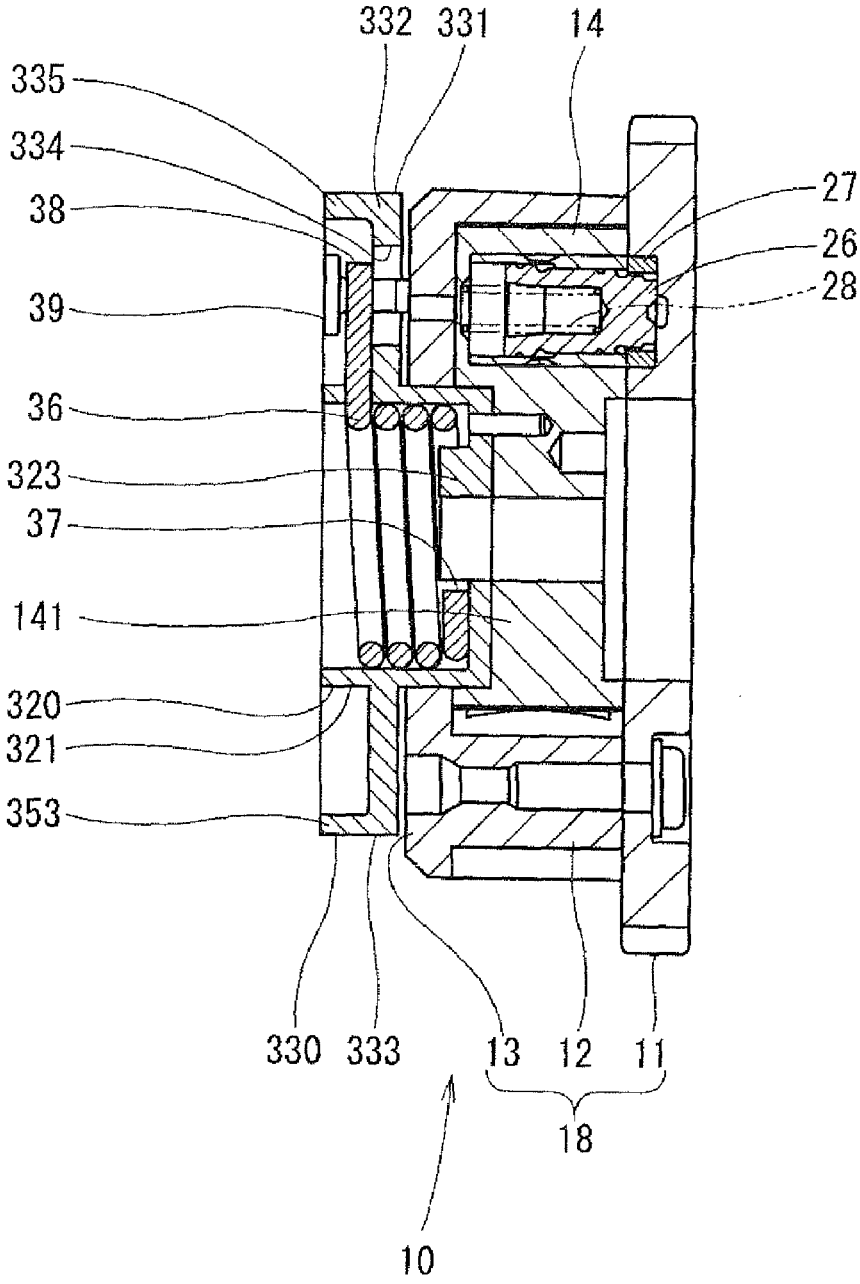
FIG. 9 is a cross sectional view taken along a line in FIG. 8.

A third embodiment differs from the first embodiment in the configuration of the bush member. Different portions will be explained with reference to FIGS. 8 and 9. The same reference numerals are used in the third embodiment for such portions which are the same or similar to those of the first embodiment, and the explanation for such portions are omitted. FIG. 8 corresponds to FIG. 2 for the first embodiment, and shows the valve timing control apparatus. FIG. 9 shows a cross sectional view taken along a line IX-O-Q-R-IX in FIG. 8, wherein only the valve timing adjusting device 10 is shown.

A bush member 320, which is fixed to the boss portion 141 of the vane rotor 14, is inserted into the center through-hole formed in the front plate 13, in such a way that the bush member 320 is coaxially arranged with the front plate 13 and a relative movement between the bush member 320 and the front plate 13 is allowed. The boss portion 141 of the vane rotor 14 is fixed to the cam shaft 2 by bolts together with the bush member 320 (FIG. 1). The bush member 320 is composed of a cup-shaped portion 321 and a signal plate 330, and so on.

The cup-shaped portion 321 is formed in a cylindrical shape having a bottom. A forward end of the cup-shaped portion 321 is inserted into the boss portion 141 of the vane rotor 14 and fixed to the vane rotor 14 by means of the bolts. The assist spring 36 is accommodated in the cup-shaped portion 321. One end 37 of the assist spring 36 is engaged with a positioning groove 324 formed at a positioning portion 323 of the cup-shaped portion 321, so that the one end 37 of the assist spring 36 rotates together with the vane rotor 14.

The signal plate 330 is integrally formed with the cup-shaped portion 321. The signal plate 330 is formed in a disc shape outwardly extending from the cup-shaped portion 321. Therefore, the signal plate 330 rotates together with the vane rotor 14 and the cam shaft 2. The signal plate 330 has a large-diameter portion 332 and a small-diameter portion 333. A long through-hole 334 extending in a circumferential direction is formed in the large-diameter portion 332. A wall portion 335 is formed at an outer periphery 331 of the signal plate 330 in such a manner that the wall portion 335 outwardly extends in the axial direction of the vane rotor 14.

The spring hook 39 is inserted into the long through-hole 334 of the signal plate 330. The spring hook 39 is fixed to the front plate 13 of the housing 18. The other end 38 of the assist spring 36 is held by the spring hook 39. Therefore, the other end 38 of the assist spring 36 can rotate together with the spring hook 39 and the housing 18 relative to the signal plate 330 within the range of the long through-hole 334. At any rotational position of the vane rotor 14 relative to the housing 18, the assist spring 36 and the spring hook 39 are positioned in the place, which is located on the radial inner side of the outer periphery 331 of the signal plate 330.

According to the above structure, since the cam angle sensor 7 (FIG. 1) does not misidentify the assist spring 36 and the spring hook 39, the cam angle sensor 7 can exactly detect the rotational angle of the cam shaft 2 which rotates together with the signal plate 330 and the vane rotor 14.

So long as the long through-hole 334 is formed in the large-diameter portion 332 at the place inside of the outer periphery 331 in the radial direction, the above effect can be achieved, even in the case that the long through-hole 334 is formed at such a place which is an outside of an outer periphery of the small-diameter portion 333 in the radial direction but within an angular range of the large-diameter portion 332.

Since the cup-shaped portion 321 is integrally formed with the signal plate 330, a number of parts and components can be reduced. In addition, since the positioning portion 323 is integrally formed with the cup-shaped portion 321, the number of parts and components is further reduced.

In addition, the signal plate 330 has the wall portion 335 at the outer periphery 331, wherein the wall portion 335 outwardly extends from the outer periphery 331 in the axial direction of the vane rotor 14. As a result, flexibility for locating the cam angle sensor 7 in the axial direction of the vane rotor 14 is increased by the height of the wall portion 335.

Fourth Embodiment

Figure 10:
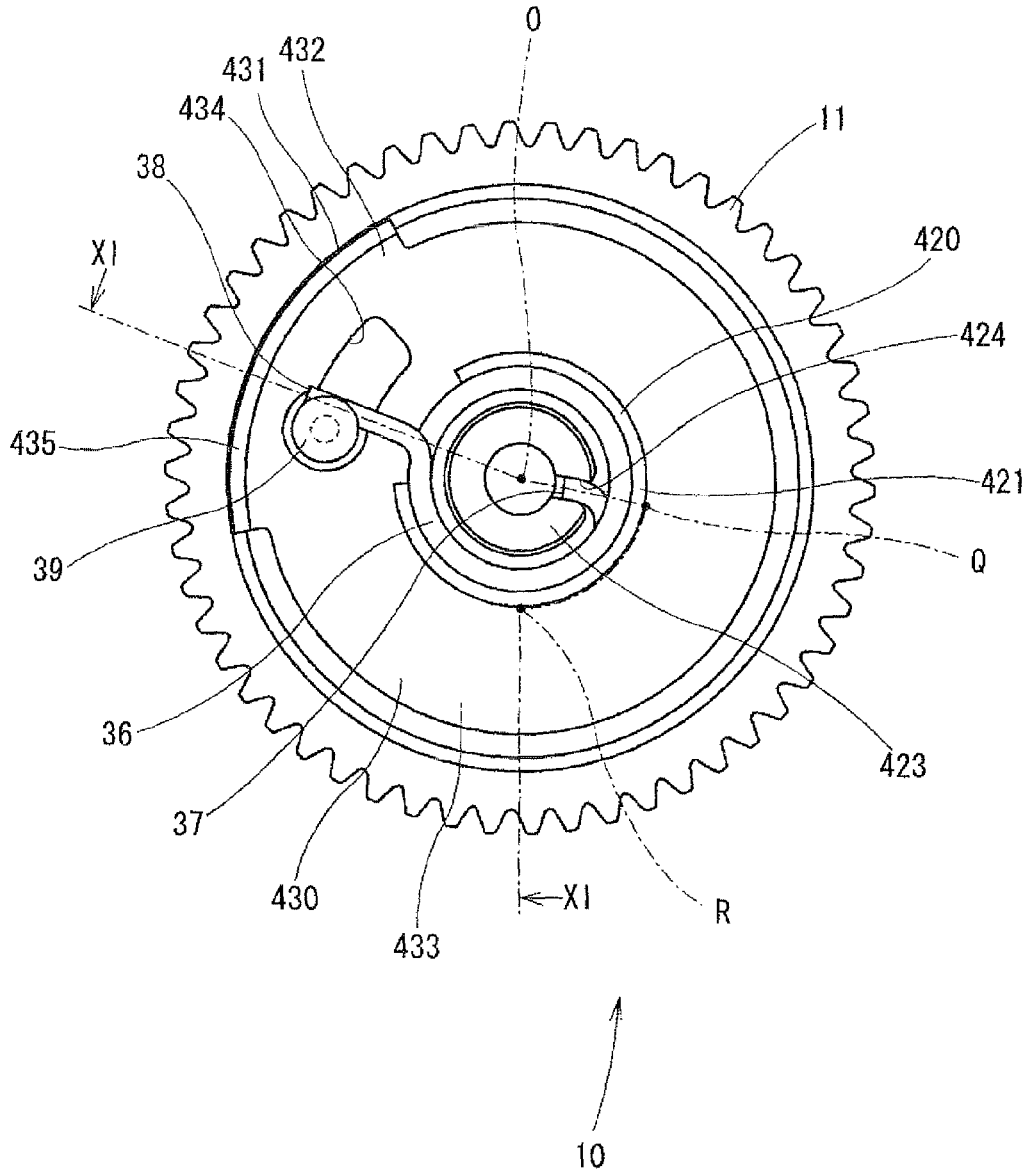
FIG. 10 is a schematic plan view showing a valve timing control apparatus according to a fourth embodiment of the invention.
Figure 11:
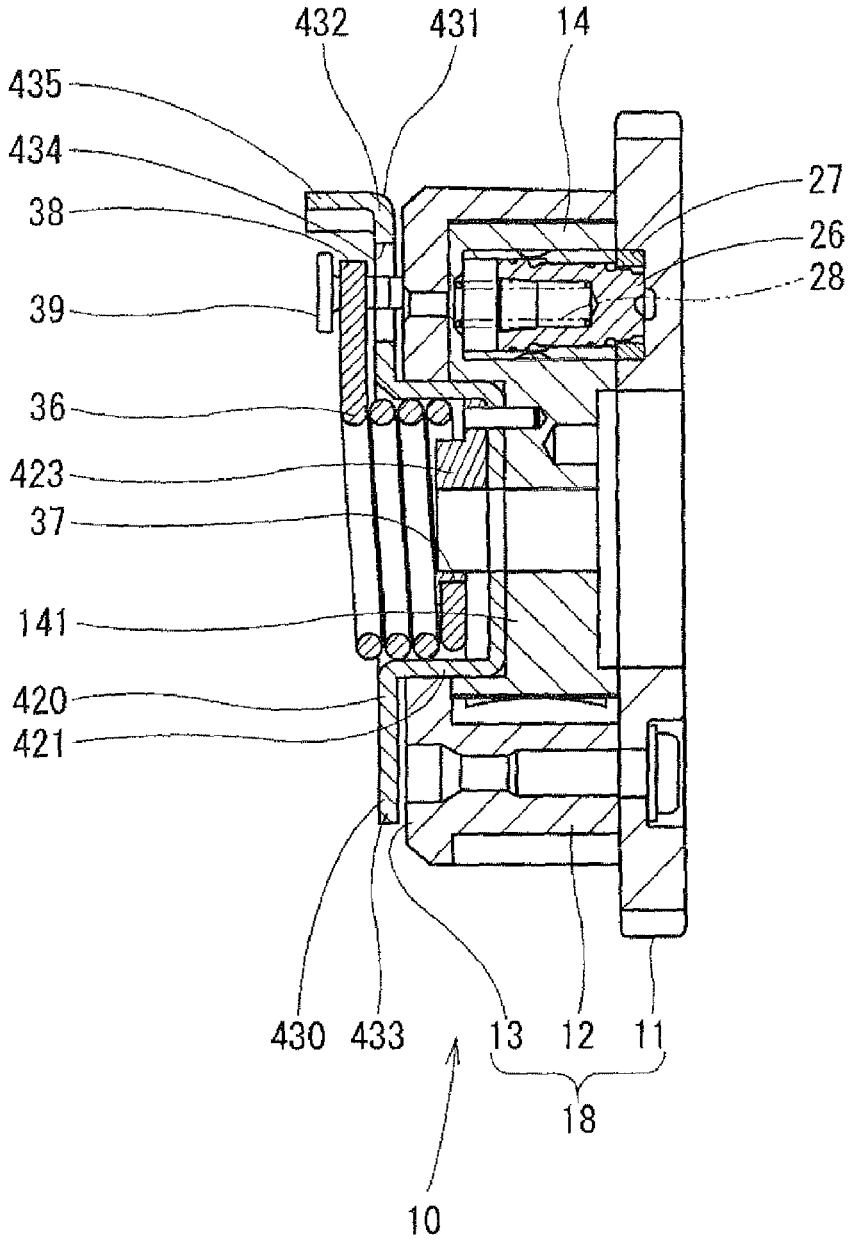
FIG. 11 is a cross sectional view taken along a line XI-O-Q-R-XI in FIG. 10.

A fourth embodiment differs from the first embodiment in the configuration of the bush member. Different portions will be explained with reference to FIGS. 10 and 11. The same reference numerals are used in the fourth embodiment for such portions which are the same or similar to those of the first embodiment, and the explanation for such portions are omitted. FIG. 10 corresponds to FIG. 2 for the first embodiment, and shows the valve timing control apparatus. FIG. 11 shows a cross sectional view taken along a line XI-O-Q-R-XI in FIG. 10, wherein only the valve timing adjusting device 10 is shown.

A bush member 420, which is fixed to the boss portion 141 of the vane rotor 14, is inserted into the center through-hole formed in the front plate 13, in such a way that the bush member 420 is coaxially arranged with the front plate 13 and a relative movement between the bush member 420 and the front plate 13 is allowed. The boss portion 141 of the vane rotor 14 is fixed to the cam shaft 2 by bolts together with the bush member 420 (FIG. 1).

The bush member 420 is composed of a cup-shaped portion 421 and a signal plate 430, and so on.

The cup-shaped portion 421 and the signal plate 430 are integrally formed by press working. The signal plate 430 rotates together with the vane rotor 14 and the cam shaft 2 (FIG. 1). A positioning member 423 having a positioning groove 424 is separately formed from the cup-shaped portion 421. The positioning member 423 is located inside of the cup-shaped portion 421 and fixed to the vane rotor 14 together with the cup-shaped portion 421 by means of bolts. The assist spring 36 is accommodated in the cup-shaped portion 421, which is formed in a cylindrical shape having a bottom. The one end 37 of the assist spring 36 is held by the positioning groove 424 of the positioning member 423, so that the one end 37 of the assist spring 36 rotates together with the vane rotor 14.

The signal plate 430, which is integrally formed with the cup-shaped portion 421 by the press working, has a large-diameter portion 432 and a small-diameter portion 433. A long through-hole 434 extending in a circumferential direction of the signal plate 430 is formed in the large-diameter portion 432. A wall portion 435 is formed only at an outer periphery 431 of the large-diameter portion 432 of the signal plate 430, wherein the wall portion 435 outwardly extends in the axial direction of the vane rotor 14. As shown in FIG. 10, the wall portion 435 is formed in an angular range which covers the circumferential length of the long through-hole 434. In other words, the wall portion 435 is formed in the angular range which is larger than that for the long through-hole 434.

The spring hook 39 is inserted into the long through-hole 434 of the signal plate 430. The spring hook 39 is fixed to the front plate 13 of the housing 18. The other end 38 of the assist spring 36 is held by the spring hook 39. Therefore, the other end 38 of the assist spring 36 can rotate together with the spring hook 39 and the housing 18 relative to the signal plate 430 within the range of the long through-hole 434. At any rotational position of the vane rotor 14 relative to the housing 18, the assist spring 36 and the spring hook 39 are positioned in the place, which is located on the radial inner side of the outer periphery 431 of the signal plate 430.

According to the above structure, since the cam angle sensor 7 (FIG. 1) does not misidentify the assist spring 36 and the spring hook 39, the cam angle sensor 7 can exactly detect the rotational angle of the cam shaft 2 which rotates together with the signal plate 430 and the vane rotor 14.

So long as the long through-hole 434 is formed in the large-diameter portion 432 at the place inside of the outer periphery 431 in the radial direction, the above effect can be achieved, even in the case that the long through-hole 434 is formed at such a place which is an outside of an outer periphery of the small-diameter portion 433 in the radial direction but within an angular range of the large-diameter portion 432.

Since the cup-shaped portion 421 is integrally formed with the signal plate 430, a number of parts and components can be reduced. The positioning member 423 is separately formed from the cu-shaped portion 421. According to the present embodiment, since the cup-shaped portion 421 and the signal plate 430 are formed by the press working, manufacturing cost can be reduced.

In addition, the signal plate 430 has the wall portion 435 at the outer periphery 431 thereof, wherein the wall portion 435 outwardly extends from the outer periphery 431 in the axial direction of the vane rotor 14. As a result, flexibility for locating the cam angle sensor 7 in the axial direction of the vane rotor 14 is increased by the height of the wall portion 435.

Fifth Embodiment

Figure 12:
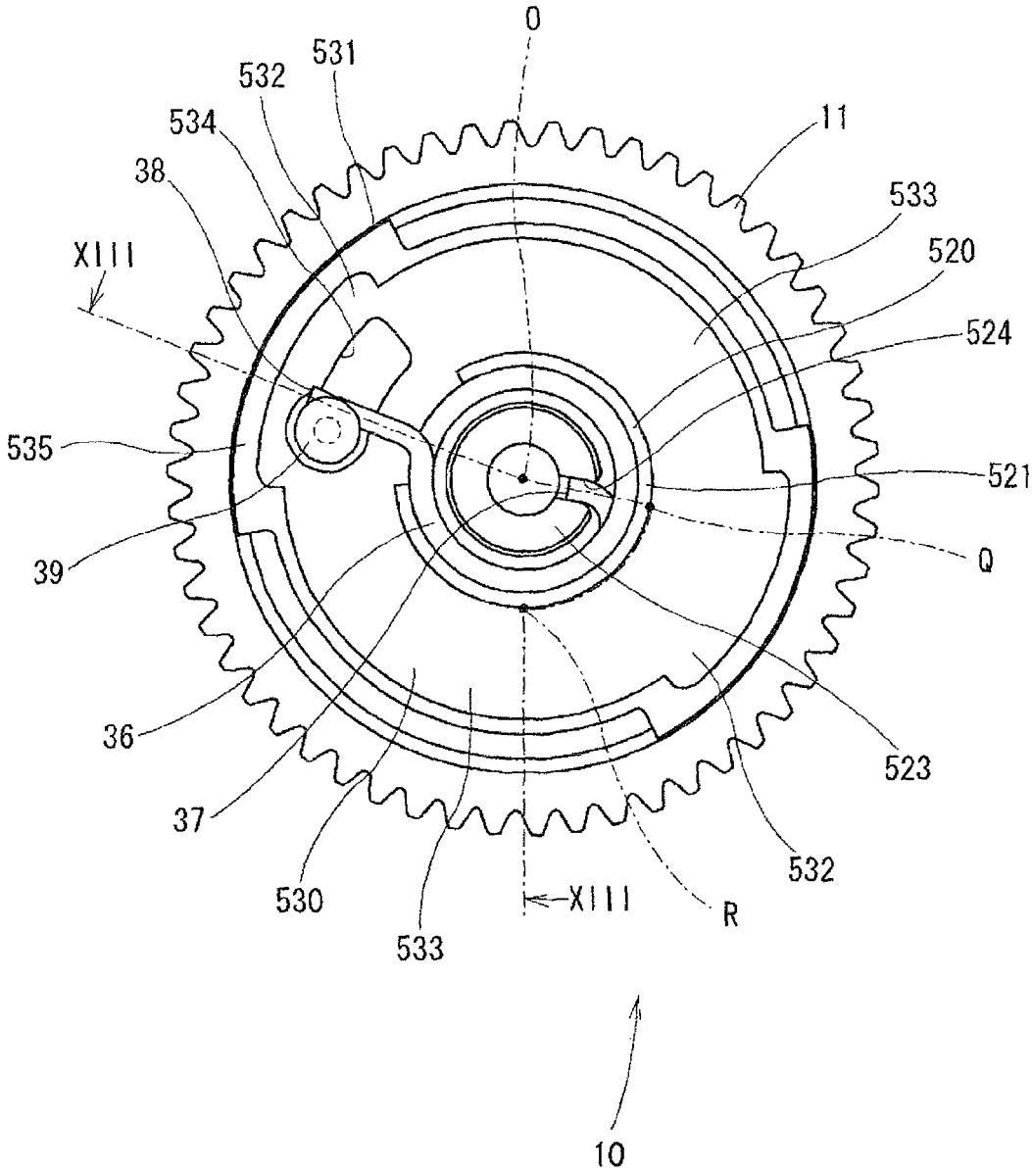
FIG. 12 is a schematic plan view showing a valve timing control apparatus according to a fifth embodiment of the invention.
Figure 13:
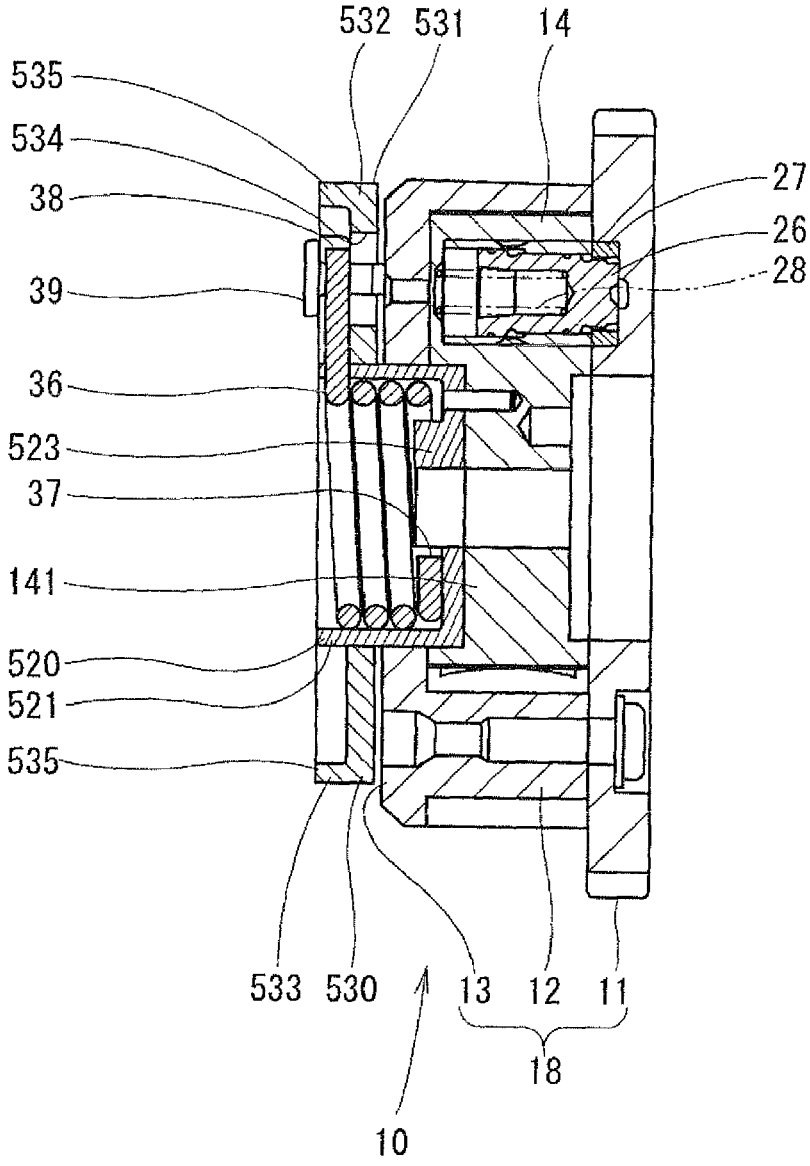
FIG. 13 is a cross sectional view taken along a line XIII-O-Q-R-XIII in FIG. 12.

A fifth embodiment differs from the first embodiment in the configuration of the bush member. Different portions will be explained with reference to FIGS. 12 and 13. The same reference numerals are used in the fifth embodiment for such portions which are the same or similar to those of the first embodiment, and the explanation for such portions are omitted. FIG. 12 corresponds to FIG. 2 for the first embodiment, and shows the valve timing control apparatus. FIG. 13 shows a cross sectional view taken along a line XIII-O-Q-R-XIII in FIG. 12, wherein only the valve timing adjusting device 10 is shown.

A bush member 520, which is fixed to the boss portion 141 of the vane rotor 14, is inserted into the center through-hole formed in the front plate 13, in such a way that the bush member 520 is coaxially arranged with the front plate 13 and a relative movement between the bush member 520 and the front plate 13 is allowed. The boss portion 141 of the vane rotor 14 is fixed to the cam shaft 2 by bolts together with the bush member 520 (FIG. 1).

The bush member 520 of the present embodiment is composed of a cup-shaped portion 521, a signal plate 530 and so on. The cup-shaped portion 521 and the signal plate 530 are separately formed from each other as sintered compacts. The cup-shaped portion 521 is press-inserted into an aperture formed in the signal plate 530. The signal plate 530 rotates together with the cup-shaped portion 521, the vane rotor 14 and the cam shaft 2. A positioning portion 523 is integrally formed with the cup-shaped portion 521.

The cup-shaped portion 521 is formed in a cylindrical shape having a bottom. A forward end of the cup-shaped portion 521 is inserted into the boss portion 141 of the vane rotor 14 and fixed to the vane rotor 14 by means of the bolts.

The assist spring 36 is accommodated in the cup-shaped portion 521. The one end 37 of the assist spring 36 is engaged with a positioning groove 524 formed at the positioning portion 523 of the cup-shaped portion 521, so that the one end 37 of the assist spring 36 rotates together with the vane rotor 14.

The signal plate 530 has a large-diameter portion 532 and a small-diameter portion 533. A long through-hole 534 extending in a circumferential direction is formed in the large-diameter portion 532. A wall portion 535 is formed at an outer periphery 531 of the signal plate 530 in such a manner that the wall portion 535 outwardly extends in the axial direction of the vane rotor 14.

The spring hook 39 is inserted into the long through-hole 534 of the signal plate 530. The spring hook 39 is fixed to the front plate 13 of the housing 18. The other end 38 of the assist spring 36 is held by the spring hook 39. Therefore, the other end 38 of the assist spring 36 can rotate together with the spring hook 39 and the housing 18 relative to the signal plate 530 within the range of the long through-hole 534. At any rotational position of the vane rotor 14 relative to the housing 18, the assist spring 36 and the spring hook 39 are positioned in the place, which is located on the radial inner side of the outer periphery 531 (the wall portion 535) of the signal plate 530.

According to the above structure, since the cam angle sensor 7 (FIG. 1) does not misidentify the assist spring 36 and the spring hook 39, the cam angle sensor 7 can exactly detect the rotational angle of the cam shaft 2 which rotates together with the signal plate 530 and the vane rotor 14.

So long as the long through-hole 534 is formed in the large-diameter portion 532 at the place inside of the outer periphery 531 in the radial direction, the above effect can be achieved, even in the case that the long through-hole 534 is formed at such a place which is an outside of an outer periphery of the small-diameter portion 533 in the radial direction but within an angular range of the large-diameter portion 532.

According to the present embodiment, since the cup-shaped portion 521 and the signal plate 530 are separately formed from each other as sintered compacts, those parts can be easily worked and thereby cost for the parts can be reduced.

In addition, the signal plate 530 has the wall portion 535 at the outer periphery 531 thereof, wherein the wall portion 535 outwardly extends from the outer periphery 531 in the axial direction of the vane rotor 14. As a result, flexibility for locating the cam angle sensor 7 in the axial direction of the vane rotor 14 is increased by the height of the wall portion 535.

Further Embodiments

In the above embodiments, the valve timing control apparatus is applied to the power transmitting system of the roller-rocker type. The valve timing control apparatus may be applied to a power transmitting system of other types.

In the above embodiments, the invention is applied to the valve timing control apparatus for the exhaust valve of the engine. However, the invention may be applied to a valve timing control apparatus for the intake valve of the engine.

In the above embodiments, the vane rotor is rotated together with the cam shaft. The vane rotor may be so arranged that it is rotated together with a crank shaft.

As above, the present invention should not be limited to the above explained embodiments, but may be modified in various ways without departing from the spirit of the invention.

What is claimed is:

1. A valve timing control apparatus for an engine, according to which a driven shaft is rotated by a driving force from a driving shaft of the engine to open and close an intake valve and an exhaust valve of the engine, and according to which a valve opening and/or closing timing for the intake valve and/or the exhaust valve is controlled by changing a rotational phase of the driven shaft relative to the driving shaft, comprising:

a housing to be rotated together with one of the driving shaft and the driven shaft;

a vane rotor connected to the other of the driving shaft and the driven shaft and rotatably supported by and in the housing, the vane rotor having multiple vanes respectively accommodated in multiple accommodating spaces of the housing to define pressure chambers at both sides of each vane, the vane rotor being capable of rotating relative to the housing depending on fluid pressure of working fluid supplied into the respective pressure chambers;

an elastic member fixed to the vane rotor at one end and fixed to the housing at the other end and for applying a spring force to the vane rotor and the housing so that a relative movement between them is realized;

a fixing member provided at an outside of the housing, which corresponds to a front side of the housing in an axial direction of the vane rotor, and for fixing the other end of the elastic member to the housing; and a signal member fixed to the vane rotor at a side of the elastic member, which is provided at the front side of the housing, in the axial direction of the vane rotor, so that a rotational angle of the vane rotor is detected by a sensor provided at an outer peripheral side of the signal member in a radial direction, wherein the elastic member and the fixing member are provided in an area which is inside of an outer periphery of the signal member in the radial direction.

2. The valve timing control apparatus according to claim 1, wherein the signal member has a large-diameter portion and a small-diameter portion, a through-hole is formed in the small-diameter portion of the signal member and extends in a circumferential direction of the signal member, and the fixing member is inserted into the through-hole in such a manner that the fixing member is movable relative to the signal member.

3. The valve timing control apparatus according to claim 1, wherein the signal member has a large-diameter portion and a small-diameter portion, a through-hole is formed in the large-diameter portion of the signal member and extends in a circumferential direction of the signal member, the fixing member inserted into the through-hole in such a manner that the fixing member is movable relative to the signal member.

4. The valve timing control apparatus according to claim 1, wherein the signal member has a wall portion outwardly extending from an outer periphery of the signal member in the axial direction of the vane rotor.

5. The valve timing control apparatus according to claim 4, wherein the signal member has a large-diameter portion and a small-diameter portion, a through-hole is formed in the large-diameter portion of the signal member and extends in a circumferential direction of the signal member, and the wall portion is formed in an angular range larger than that of the through-hole.

6. The valve timing control apparatus according to claim 1, wherein the signal member has a spring accommodating portion for accommodating the elastic member therein and the one end of the elastic member is fixed to a positioning portion formed in the spring accommodating portion.

7. The valve timing control apparatus according to claim 6, wherein the signal member and the spring accommodating portion are integrally formed with each other.

8. The valve timing control apparatus according to claim 6, wherein the signal member is separately formed from the spring accommodating portion.

9. The valve timing control apparatus according to claim 6, wherein the positioning portion is integrally formed with the spring accommodating portion.

10. The valve timing control apparatus according to claim 6, wherein the positioning portion is separately formed from the spring accommodating portion.

* * * * *